US011486674B2

(12) United States Patent
McPherson

(10) Patent No.: US 11,486,674 B2
(45) Date of Patent: Nov. 1, 2022

(54) ARCHERY BOW ROTATABLE MEMBER SUPPORT

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 17/478,507

(22) Filed: Sep. 17, 2021

(65) Prior Publication Data

US 2022/0082349 A1 Mar. 17, 2022

Related U.S. Application Data

(60) Provisional application No. 63/079,689, filed on Sep. 17, 2020.

(51) Int. Cl.
*F41B 5/10* (2006.01)
*F41B 5/14* (2006.01)

(52) U.S. Cl.
CPC ..... *F41B 5/105* (2013.01); *F41B 5/1403* (2013.01)

(58) Field of Classification Search
CPC ..... F41B 5/10; F41B 5/105
See application file for complete search history.

(56) References Cited

U.S. PATENT DOCUMENTS

| | | | | |
|---|---|---|---|---|
| 6,415,780 | B1 * | 7/2002 | Proctor | F41B 5/10 124/900 |
| 6,964,271 | B2 | 11/2005 | Andrews | |
| 7,047,958 | B1 | 5/2006 | Colley | |
| 7,938,109 | B1 | 5/2011 | Larson | |
| 7,971,582 | B1 | 7/2011 | Larson | |
| 8,020,544 | B2 | 9/2011 | McPherson et al. | |
| 8,069,848 | B1 | 12/2011 | Larson | |
| 8,671,925 | B2 | 3/2014 | Grace | |
| 8,789,519 | B2 | 7/2014 | Nebergall | |
| 9,528,788 | B2 | 12/2016 | McPherson | |
| 9,851,169 | B2 | 12/2017 | McPherson et al. | |
| 10,126,087 | B1 * | 11/2018 | Grace | F41B 5/123 |

* cited by examiner

*Primary Examiner* — John A Ricci
(74) *Attorney, Agent, or Firm* — Laabs Intellectual Property

(57) ABSTRACT

In some embodiments, an archery bow comprises a limb supported by a riser and an axle supported by the limb. A plurality of bearings are supported by the axle, which comprise a first dynamic bearing and a second dynamic bearing. A rotatable member is supported by the plurality of bearings. The first dynamic bearing is shaped differently from the second dynamic bearing. In some embodiments, the axle comprises a non-contacting length portion comprising less than 15% of the axle length.

18 Claims, 8 Drawing Sheets

ARCHERY BOW ROTATABLE MEMBER SUPPORT

CROSS-REFERENCE TO RELATED APPLICATIONS

This application claims the benefit of U.S. Patent Application No. 63/079,689, filed Sep. 17, 2020, the entire content of which is hereby incorporated herein by reference.

BACKGROUND OF THE INVENTION

This invention relates generally to archery bows and more specifically to compound bows having rotating members.

Archery bows are generally known in the art. Compound archery bows often comprise rotating members, a bowstring and at least one power cable. The bowstring and cable(s) may terminate on the rotating member and may be under a high amount of tension. Hundreds of pounds of force may transfer across a rotating member, through an axle that supports the rotating member and to a limb that supports the axle.

Some examples of rotatable member support arrangements are shown in U.S. Pat. Nos. 4,660,536, 6,871,643 and 8,671,925.

There remains a need for novel archery bow designs that provide greater amounts of efficiency and longevity than known designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a limb supported by a riser and an axle supported by the limb. A plurality of bearings are supported by the axle, which comprise a first dynamic bearing and a second dynamic bearing. A rotatable member is supported by the plurality of bearings. The first dynamic bearing is shaped differently from the second dynamic bearing.

In some embodiments, the first dynamic bearing spans a greater length along the axle than the second dynamic bearing.

In some embodiments, an inner race of the first dynamic bearing is shaped differently from the inner race of the second dynamic bearing.

In some embodiments, the inner race of the first dynamic bearing comprises a length that is greater than a length of the second dynamic bearing. In some embodiments, an outer race of the first dynamic bearing is shaped similarly to an outer race of the second dynamic bearing.

In some embodiments, an outer race of the first dynamic bearing is symmetrical across a reference plane and an inner race of the first dynamic bearing is asymmetrical across the reference plane.

In some embodiments, the plurality of bearings comprises a third dynamic bearing.

In some embodiments, the axle comprises a length and a non-contacting length portion oriented between the first dynamic bearing and the second dynamic bearing. In some embodiments, the non-contacting length portion comprises less than 15% of the axle length.

In some embodiments, an archery bow comprises a limb supported by a riser and an axle supported by the limb. A plurality of bearings are supported by the axle, which comprise a first dynamic bearing and a second dynamic bearing. A rotatable member is supported by the plurality of bearings. The axle comprises a non-contacting length portion oriented between the first dynamic bearing and the second dynamic bearing. In some embodiments, the non-contacting length portion comprises less than 15% of the axle length.

In some embodiments, the non-contacting length portion comprises less than 10% of the axle length. In some embodiments, the non-contacting length portion comprises less than 5% of the axle length. In some embodiments, the non-contacting length portion comprises less than 1% of the axle length.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
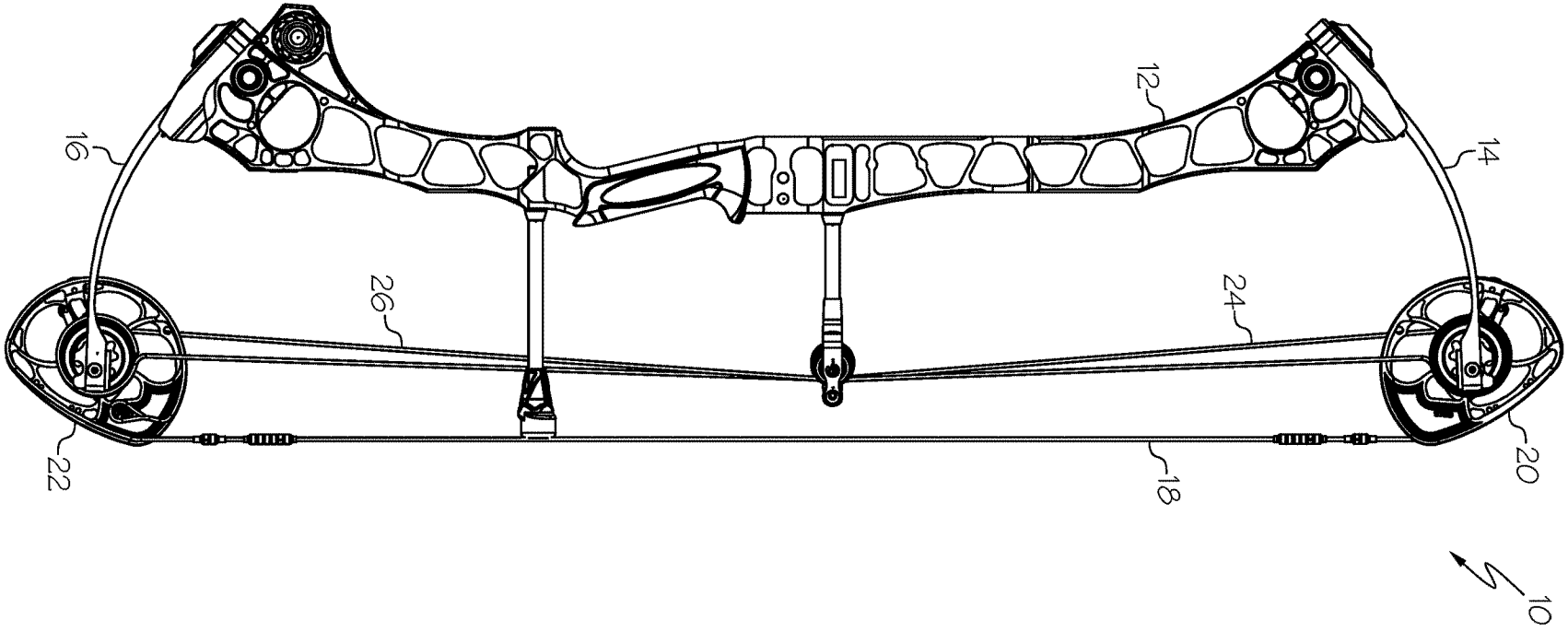
FIG. 1 shows a side profile of an embodiment of a compound archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
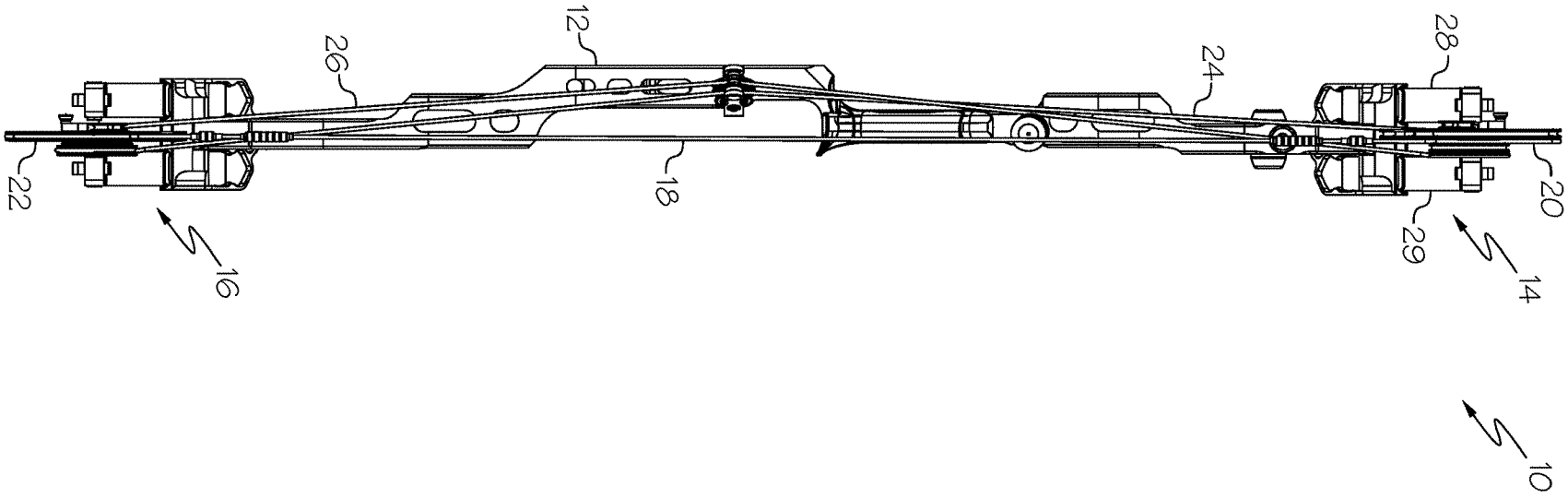
FIG. 2 shows a rear profile of an embodiment of a compound archery bow.

FIG. 1 shows a side profile of an embodiment of a compound archery bow 10 and FIG. 2 shows a rear profile. In some embodiments an archery bow 10 comprises a riser 12 arranged to support a first limb 14 and a second limb 16. In some embodiments, the first limb 14 supports a first rotatable member 20 and the second limb 16 supports a second rotatable member 22. In some embodiments, a compound archery bow 10 comprises a bowstring 18 and at least one power cable 24. In some embodiments, a compound archery bow 10 comprises a first power cable 24 and a second power cable 26. In some embodiments, the first power cable 24 is attached at one end to the first rotatable member 20 and attached at the other end to the second rotatable member 22. In some embodiments, the second power cable 24 is attached at one end to the second rotatable member 22 and attached at the other end to the first rotatable member 20.

In some embodiments, a limb 14, 16 comprises a limb assembly comprising a first limb member 28 and a second limb member 29, wherein the limb members 28, 29 collectively support an associated rotatable member 20. In some embodiments, the limb members 28, 29 of a limb assembly extend parallel to one another. In some embodiments, a rotatable member 20 is positioned between the limb members 28, 29 of a limb assembly. In some embodiments, the limb members 28, 29 are spaced to provide a predetermined clearance for a rotatable member 20.

Figure 3:
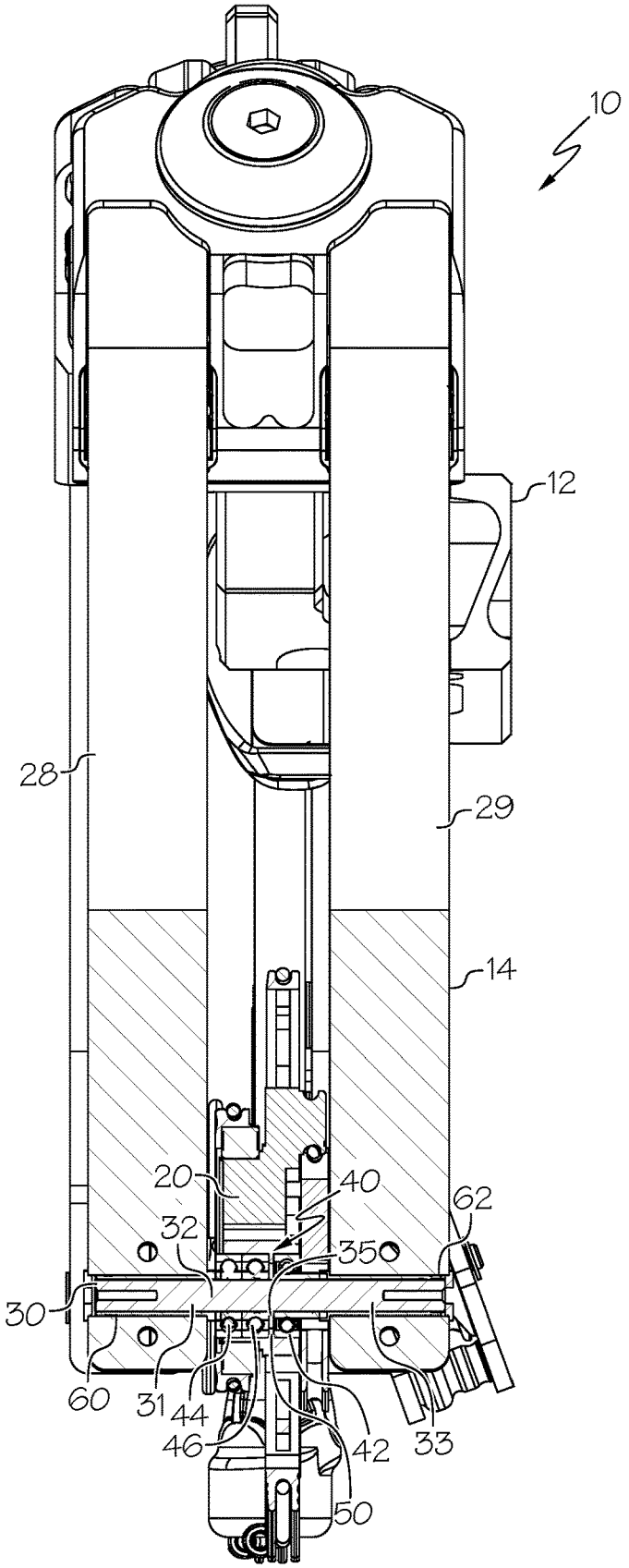
FIG. 3 shows a partial sectional view of an embodiment of a compound archery bow.

FIG. 3 shows a partial sectional view of a portion of the compound bow of FIG. 1. In some embodiments, a limb assembly 14 is arranged to support an axle 30. In some embodiments, a first limb member 28 is arranged to support a first end portion 31 of the axle 30 and a second limb member 29 is arranged to support a second end portion 33 of the axle 30. In some embodiments, a static bearing 60 is positioned between the first limb member 28 and the axle 30. In some embodiments, a second static bearing 62 is positioned between the second limb member 29 and the axle 30. In some embodiments, the static bearings 60, 62 each comprise a flange located between an associated limb member 28, 29 and the rotatable member 20 and/or other suitable arrangements as described in U.S. Pat. No. 9,528,788, the entire content of which is hereby incorporated herein by reference.

In some embodiments, an axle 30 comprises an unsupported portion 32 extending between the first end portion 31 and the second end portion 33. In some embodiments, the unsupported portion 33 of the axle 30 is arranged to support the rotatable member 20. In some embodiments, the axle 30 supports a bearing 40 and the bearing 40 supports a rotatable member 20. In some embodiments, the axle 30 supports a plurality of bearings 40 and the plurality of bearings 40 collectively support the rotatable member 20. In some embodiments, the plurality of bearings 40 comprise a first dynamic bearing 42 and a second dynamic bearing 44. In some embodiments, the plurality of bearings 40 further comprise a third dynamic bearing 46. In some embodiments, each dynamic bearing 42, 44, 46 contacts the unsupported portion 33 of the axle 30. In some embodiments, each dynamic bearing 42, 44, 46 contacts the rotatable member 20.

In some embodiments, the axle 30 remains static with respect to the limb assembly 14. In some embodiments, the axle 30 remains static with respect to static bearings 60, 62 positioned between the axle 30 and limb assembly 14. Desirably, the rotatable member 20 is arranged to rotate with respect to the limb assembly 14. In some embodiments, the rotatable member 20 is arranged to rotate with respect to the axle 30.

In some embodiments, a rotatable member 20 is directly supported only by the dynamic bearings 42, 44, 46, and does not contact the axle 30 or limb assembly 14.

In some embodiments, a bearing 40 comprises a sleeve bearing.

In some embodiments, a bearing 40 comprises a roller bearing. In some embodiments, a bearing 40 comprises ball bearings.

In some embodiments, a gap 50 exists between adjacent dynamic bearings (e.g. 42 and 46). In some embodiments, the unsupported portion 33 of the axle 30 comprises a non-contacting portion 35 that does not contact any supporting or supported structure. For example, in some embodiments, the non-contacting portion 35 of the axle 30 does not contact a dynamic bearing 42, 44, 46. In some embodiments, a non-contacting portion 35 of the axle 30 is located between two adjacent dynamic bearings 42, 46.

In some embodiments, some adjacent dynamic bearings 44, 46 contact one another. In some embodiments, a dynamic bearing 42, 44, 46 is arranged to contact a static bearing 60, 62. FIG. 3 shows the first dynamic bearing 42 contacting the second static bearing 62 and the second dynamic bearing 44 contacting the first static bearing 60.

Figure 4:
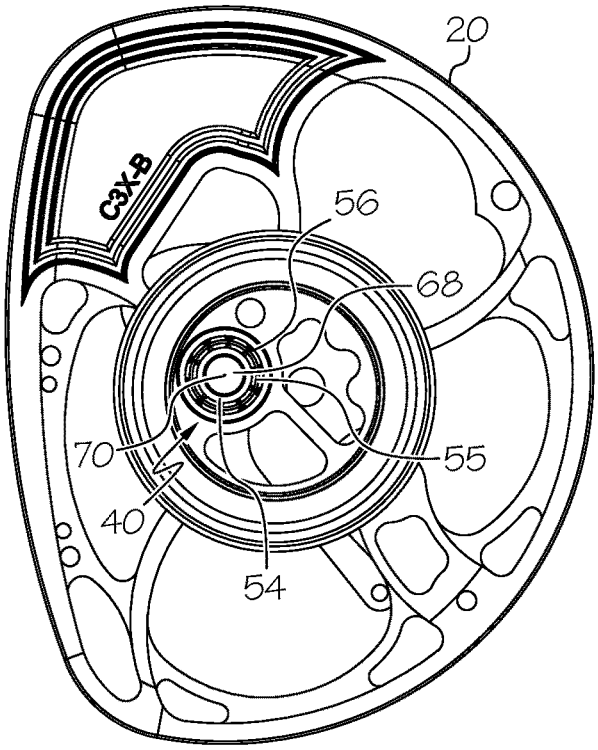
FIG. 4 shows a side profile of an embodiment of a rotatable member.
Figure 5:
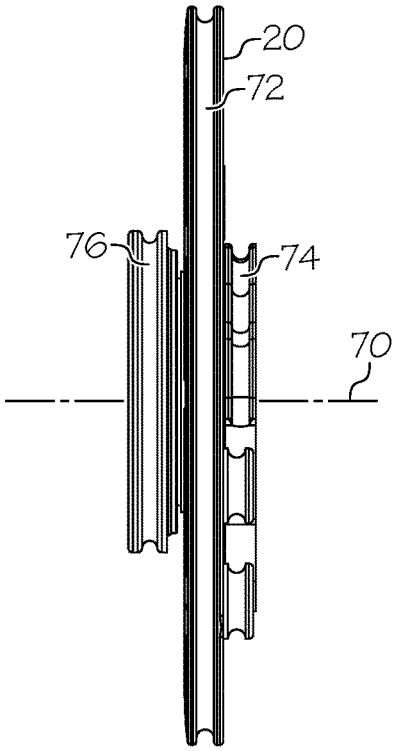
FIG. 5 shows a rear profile of an embodiment of a rotatable member.

FIG. 4 shows a side view of an embodiment of a rotatable member 20 and FIG. 5 shows an end view. In some embodiments, rotatable member 20 comprises a cavity 68 for receiving a plurality of bearings 40. In some embodiments, a rotation axis 70 of the rotatable member 20 is centered in the cavity 68.

In some embodiments, a bearing 40 comprises a roller bearing comprising an inner race 54, an outer race 56 and a plurality of rollers 55, wherein the inner race 54 moves with respect to the outer race 56. In some embodiments, the rollers 55 comprise ball bearings. In some embodiments, an inner race 54 is arranged to contact an axle 30 (not shown). In some embodiments, an outer race 56 is attached to a rotatable member 20.

In some embodiments, a rotatable member 20 comprises a bowstring track 72 arranged to unspool bowstring 18 as the bow 10 is drawn. In some embodiments, a rotatable member 20 comprises a power cable track 74 arranged to spool power cable 24 as the bow 10 is drawn. In some embodiments, a rotatable member 20 comprises a dynamic anchor 76, for example as described in U.S. Pat. No. 9,759,507, the entire content of which is hereby incorporated herein by reference.

Figure 6:
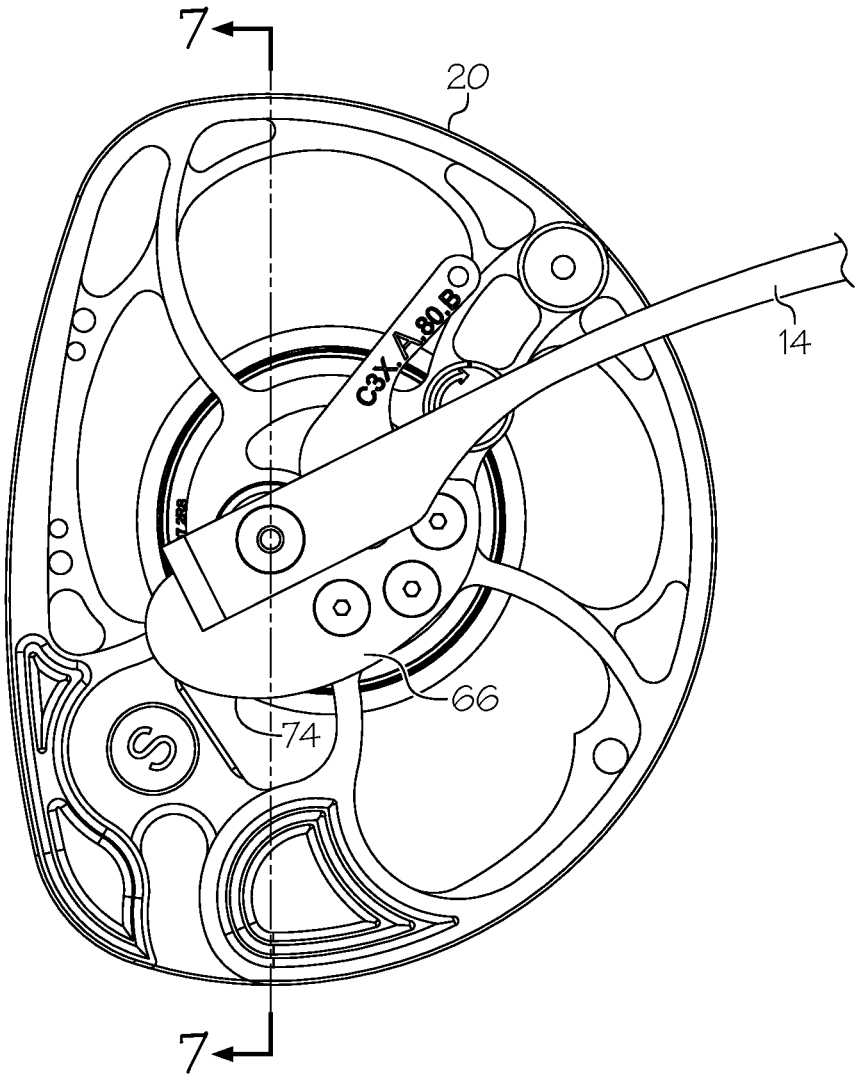
FIG. 6 shows a side profile of an embodiment of a rotatable member and an embodiment of limb assembly.

FIG. 6 shows a side view of an embodiment of a rotatable member 20. In some embodiments, a rotatable member 20 comprises a module 66 that can be detached and replaced with alternatively shaped modules, for example as described in US 2020/0224991, the entire content of which is hereby incorporated herein by reference. In some embodiments, a module 66 comprises at least a portion of the power cable track 74 of the rotatable member 20, and changing modules 66 can change draw characteristics of the bow 10.

Figure 7:
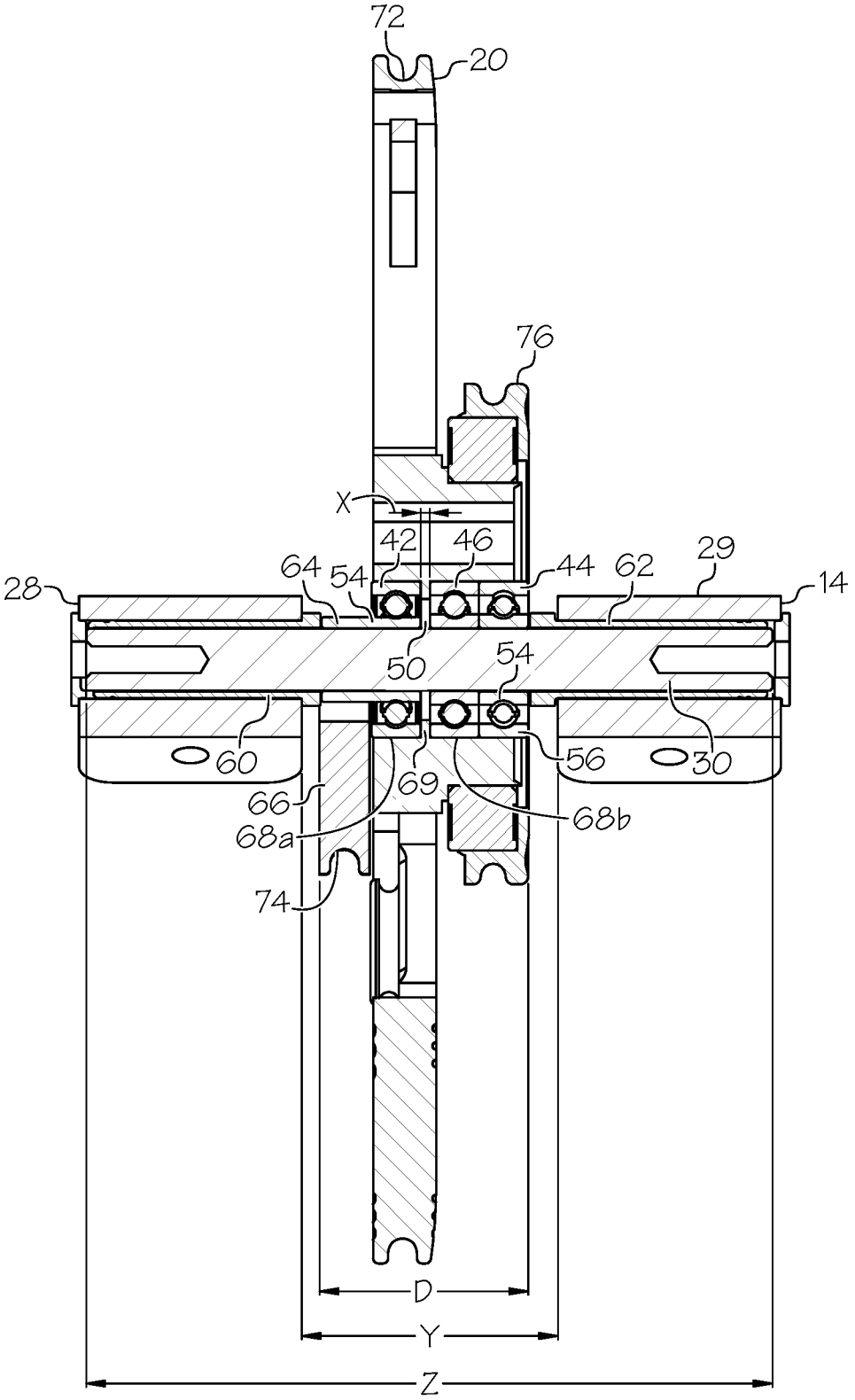
FIG. 7 shows a sectional view of an embodiment of FIG. 6.

FIG. 7 shows a sectional view of an embodiment of a support arrangement for a rotatable member 20. In some embodiments, a rotatable member 20 is collectively supported by a first dynamic bearing 42 and a second dynamic bearing 44. In some embodiments, the first dynamic bearing 42 is shaped differently from the second dynamic bearing 44.

In some embodiments, a dynamic bearing 42, 44 comprises an inner race 54 and an outer race 56. In some embodiments, a dynamic bearing 42 comprises an inner race comprising a length that is different from the length of the outer race 56. As used herein, the "length" of a race amounts to the span of the race along the length of the axle 30.

In some embodiments, a dynamic bearing 42 comprises an inner race 54 having a length that is greater than a length of the outer race 56. In some embodiments, the outer race 56 of the first dynamic bearing 42 is shaped similarly to the outer race 56 of the second dynamic bearing 44. In some embodiments, the inner race 54 of the first dynamic bearing 42 is shaped differently from the inner race 54 of the second dynamic bearing 44. In some embodiments, the inner race 54 of the first dynamic bearing 42 is longer than the inner race 54 of the second dynamic bearing 44. In some embodiments, the inner race 54 of the first dynamic bearing 42 comprises an extension 64. In some embodiments, the extension 64 is located to one side of the first dynamic bearing 42 and the first dynamic bearing is asymmetrical.

In some embodiments, the first dynamic bearing 42 contacts the first static bearing 60. In some embodiments, the inner race 54 of the first dynamic bearing 42 contacts the first static bearing 60. In some embodiments, the extension 64 of the inner race 54 of the first dynamic bearing 42 contacts the first static bearing 60. In some embodiments, the second dynamic bearing 44 contacts the second static bearing 62. In some embodiments, the inner race 54 of the second dynamic bearing 44 contacts the second static bearing 62.

In some embodiments, the rotatable member 20 is collectively supported by the first dynamic bearing 42, the second dynamic bearing 44 and a third dynamic bearing 46. In some embodiments, the second dynamic bearing 44 and the third dynamic bearing 46 are similarly sized and shaped. In some embodiments, the second dynamic bearing 44 contacts the third dynamic bearing 46. In some embodiments, the third dynamic bearing 46 is positioned between the first dynamic bearing 42 and the second dynamic bearing 44. In some embodiments, a spacing gap 50 exists between the first dynamic bearing 42 and the third dynamic bearing 46, and a portion of the axle 30 under the gap 50 comprises a non-contacting portion 35 that does not contact another portion of the structure.

In some embodiments, the rotatable member 20 comprises a cavity 68 and dynamic bearings 42, 44, 46 are positioned in the cavity 68. In some embodiments, the cavity 68 comprises a first portion 68*a* and a second portion 68*b* separated by a flange 69. In some embodiments, the flange 69 is integral to the rotatable member 20. In some embodiments, dynamic bearings 42, 46 are positioned on opposite sides of the flange 69. In some embodiments, the flange 69 defines the gap 50 between dynamic bearings 42, 46. In some embodiments, the first dynamic bearing 42 is oriented in the first portion 68*a*. In some embodiments, the second dynamic bearing 44 and the third dynamic bearing 46 are oriented in the second portion 68*b*.

In some embodiments, the non-contacting portion 35 spans a distance X along the length of the axle 30. In some embodiments, a length of the non-contacting portion 35 is minimized. Having a majority of the unsupported portion 32 of the axle 30 in contact with the dynamic bearings 42, 44, 46 reinforces the axle 30 in bending along its length, which can reduce deflections and minimize losses attributed to the dynamic bearings 42, 44, 46, for example due to uneven wear.

In some embodiments, a distance D comprises a span of the dynamic bearings 42, 44. In some embodiments, the distance extends from a first end of the first dynamic bearing 42 to a second end of the second dynamic bearing 44. In some embodiments, a third dynamic bearing 46 is oriented within the distance D.

In some embodiments, a distance Y comprises a distance between limb members 28, 29 arranged to support the axle 30. In some embodiments, the distance Y extends from an inner side of the first limb member 28 to an inner side of the second limb member 29.

In some embodiments, a distance Z is the length of the axle 30.

In other embodiments, non-contacting distance X is less than 20% of dynamic bearing span distance D. In some embodiments, the non-contacting distance X is less than 15% of dynamic bearing span distance D. In some embodiments, the non-contacting distance X is equal to or less than 10% of the dynamic bearing span distance D. In some embodiments, the non-contacting distance X is equal to or less than 5% of the dynamic bearing span distance D. In some embodiments, the non-contacting distance X is approximately 4.5% of the dynamic bearing span distance D.

In some embodiments, the non-contacting distance X is less than 20% of limb member gap distance Y. In some embodiments, the non-contacting distance X is less than 15% of limb member gap distance Y. In some embodiments, the non-contacting distance X is equal to or less than 10% of the limb member gap distance Y. In some embodiments, the non-contacting distance X is equal to or less than 5% of the limb member gap distance Y. In some embodiments, the non-contacting distance X is approximately 3.8% of limb member gap distance Y.

In some embodiments, the non-contacting distance X is less than 10% of axle length distance Z. In some embodiments, the non-contacting distance X is equal to or less than 5% of the axle length distance Z. In some embodiments, the non-contacting distance X is equal to or less than 2% of the axle length distance Z. In some embodiments, the non-contacting distance X is approximately 1.4% of axle length distance Z.

In some embodiments, the dynamic bearings 42, 44, 46 are sized and shaped similar to one another. In some embodiments, a first dynamic bearing 42 is different from another dynamic bearing of the device. In some embodiments, an inner race 54 of the first dynamic bearing 42 is shaped differently from the inner race 54 of the second dynamic bearing 44, and the outer race 56 of the first dynamic bearing 42 is shaped similarly to the inner race 54 of the second dynamic bearing 44. In some embodiments, a bearing groove of the inner race 54 of the first dynamic bearing 42 is shaped similarly to a bearing groove of the inner race 54 of the second dynamic bearing 44, and the length of the inner race 54 of the first dynamic bearing 42 is greater than the length of the inner race 54 of the second dynamic bearing 44.

In some embodiments, a dynamic anchor 76 comprises an anchor bearing 77. In some embodiments, an anchor bearing 77 comprises a roller bearing. In some embodiments, the anchor bearing 77 is larger than the dynamic bearings 42, 44, 46. In some embodiments, the anchor bearing 77 is positioned to surround at least one dynamic bearing 44. In some embodiments, the anchor bearing 77 is positioned to surround multiple dynamic bearings 44, 46.

Figure 8:
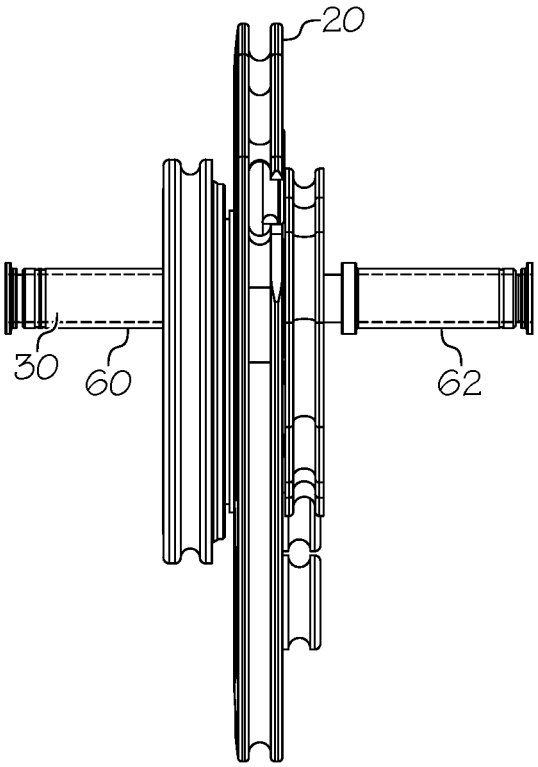
FIG. 8 shows an end view of an embodiment of a rotatable member assembly.
Figure 9:
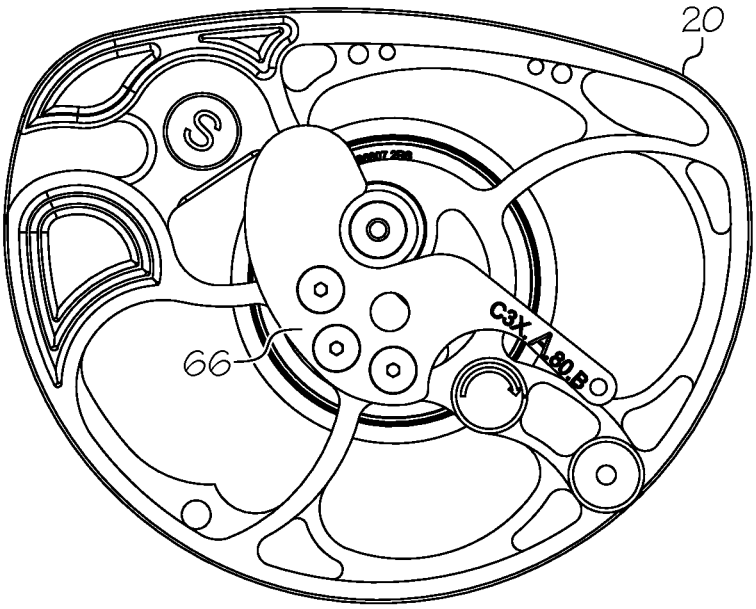
FIG. 9 shows a side profile of an embodiment of a rotatable member assembly.

FIG. 8 shows an end view of an embodiment of a rotatable member 20 with an embodiment of an axle 30. FIG. 9 shows a side view. In some embodiments, a static bearing 60, 62 is positioned between the axle 30 and a limb member. In some embodiments, a static bearing 60, 62 contacts a dynamic bearing 42, 44.

Figure 10:
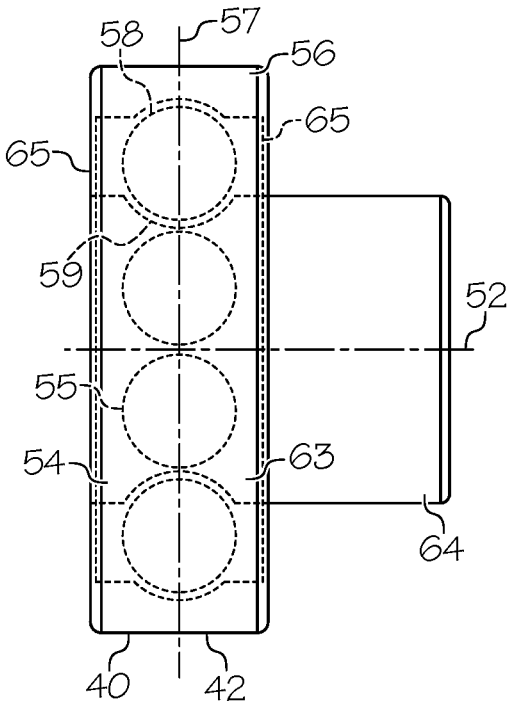
FIG. 10 shows a side view of an embodiment of a bearing.
Figure 11:
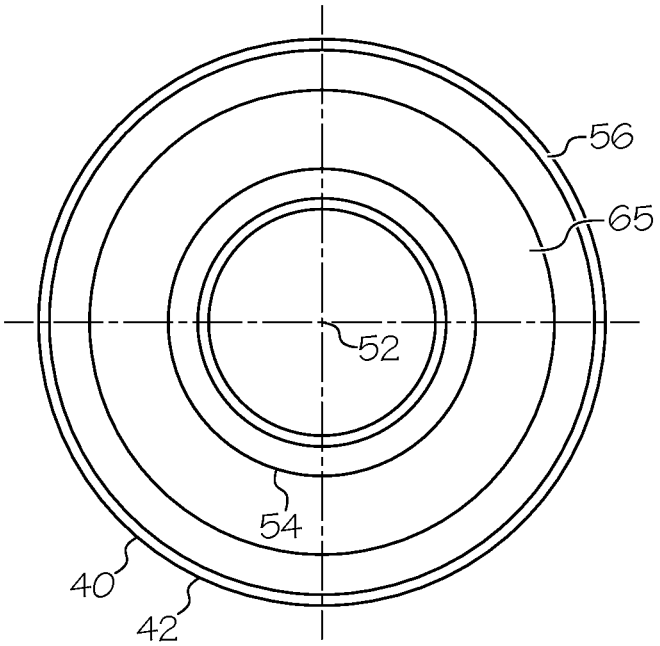
FIG. 11 shows an end view of the bearing shown in FIG. 10.

FIG. 10 shows a side view of an embodiment of bearing 40 such as a dynamic bearing 42. FIG. 11 shows an end view. In some embodiments, a dynamic bearing 42 comprises an inner race 54, an outer race 56 and a plurality of rolling elements 55. In some embodiments, the outer race 56 comprises a groove 58, for example formed in its inner periphery. In some embodiments, the inner race 54 comprises a groove 59, for example formed in its outer periphery. In some embodiments, the grooves 58, 59 form a track that contains the rolling elements 55.

In some embodiments, the dynamic bearing 42 defines a reference plane 57. In some embodiments, the reference plane 57 is orthogonal to a central axis 52 of the dynamic bearing 42. In some embodiments, the outer race 56 is centered upon the reference plane 57. In some embodiments, the groove 58 of the outer race 56 is centered upon the reference plane 57. In some embodiments, the groove 59 of the inner race 54 is centered upon the reference plane 57. In some embodiments, the rolling elements 55 are centered upon the reference plane 57. In some embodiments, the inner race 54 comprises a first portion 63 and an extension 64. In some embodiments, the first portion 63 of the inner race 54 is centered upon the reference plane 57. In some embodiments, the extension 64 of the inner race 54 is not centered upon the reference plane 57. In some embodiments, the extension 64 is located to one side of the reference plane 57. In some embodiments, the first portion 63 and an extension 64 of the inner race 54 are integral. In some embodiments, a length of the extension 64 is equal to or greater than a length of the outer race 56.

In various embodiments, the extension 64 portion of the inner race 54 can have any suitable length. In some embodiments, a length of the inner race 54 is greater than a length of the outer race 56. In some embodiments, a length of the inner race 54 is at least 1.2 times the length of the outer race 56. In some embodiments, a length of the inner race 54 is at least 1.5 times the length of the outer race 56. In some embodiments, a length of the inner race 54 is at 2 times the length of the outer race 56. In some embodiments, a length of the inner race 54 is at least 3 times the length of the outer race 56.

In some embodiments, an extension 64 of the inner race 54 comprises a sleeve member that surrounds and reinforces an axle 30 against bending. In some embodiments, an extension 64 of the inner race 54 comprises a spacer used to position the dynamic bearing 42 with respect to adjacent structure.

In some embodiments, a dynamic bearing 42 comprises one or more dust shield(s) 65 oriented between the inner race 54 and the outer race 56. In some embodiments, the extension 64 is offset to a first side of a dust shield 65. In some embodiments, the extension 64 is offset to a first side of multiple dust shields 65.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a limb supported by a riser;

an axle supported by the limb, the axle comprising a length;

a plurality of bearings supported by the axle, the plurality of bearings comprising a first dynamic bearing and a second dynamic bearing; and a rotatable member supported by the plurality of bearings;

the axle comprising a non-contacting length portion, the non-contacting length portion oriented between the first dynamic bearing and the second dynamic bearing, the non-contacting length portion comprising less than 15% of the axle length.

2. The archery bow of claim 1, the non-contacting length portion comprising less than 10% of the axle length.

3. The archery bow of claim 1, the non-contacting length portion comprising less than 5% of the axle length.

4. The archery bow of claim 1, the non-contacting length portion comprising less than 1% of the axle length.

5. The archery bow of claim 1, wherein the first dynamic bearing is shaped differently from the second dynamic bearing.

6. The archery bow of claim 5, wherein an inner race of the first dynamic bearing is shaped differently from the inner race of the second dynamic bearing.

7. The archery bow of claim 6, the inner race of the first dynamic bearing comprising a length that is greater than a length of the second dynamic bearing.

8. The archery bow of claim 1, the plurality of bearings comprising a third dynamic bearing.

9. The archery bow of claim 8, wherein the second dynamic bearing contacts the third dynamic bearing.

10. An archery bow comprising:

a limb supported by a riser;

an axle supported by the limb;

a plurality of bearings supported by the axle, the plurality of bearings comprising a first dynamic bearing and a second dynamic bearing; and a rotatable member supported by the plurality of bearings;

the first dynamic bearing shaped differently from the second dynamic bearing.

11. The archery bow of claim 10, the first dynamic bearing spanning a greater length along the axle than the second dynamic bearing.

12. The archery bow of claim 10, wherein an inner race of the first dynamic bearing is shaped differently from the inner race of the second dynamic bearing.

13. The archery bow of claim 12, the inner race of the first dynamic bearing comprising a length that is greater than a length of the second dynamic bearing.

14. The archery bow of claim 12, wherein an outer race of the first dynamic bearing is shaped similarly to an outer race of the second dynamic bearing.

15. The archery bow of claim 10, wherein an outer race of the first dynamic bearing is symmetrical across a reference plane and an inner race of the first dynamic bearing is asymmetrical across the reference plane.

16. The archery bow of claim 10, the plurality of bearings comprising a third dynamic bearing.

17. The archery bow of claim 16, the third dynamic bearing contacting the second dynamic bearing.

18. The archery bow of claim 10, the axle comprising a length and a non-contacting length portion oriented between the first dynamic bearing and the second dynamic bearing, the non-contacting length portion comprising less than 15% of the axle length.

* * * * *